United States Patent [19]

Simjian

[11] 4,278,254

[45] Jul. 14, 1981

[54] GOLF PUTTING DEVICE

[76] Inventor: Luther G. Simjian, 1750 S. Ocean La., Fort Lauderdale, Fla. 33316

[21] Appl. No.: 174,195

[22] Filed: Jul. 31, 1980

Related U.S. Application Data

[63] Continuation-in-part of Ser. No. 89,613, Oct. 29, 1979, abandoned.

[51] Int. Cl.[3] ..... A63B 69/36

[52] U.S. Cl. ..... 273/183 C; 273/58 K

[58] Field of Search ..... 273/183 C, 184 A, 58 K, 273/199 R, 199 A, 128 R, 58 R; 46/211, 220, 29

[56] References Cited

U.S. PATENT DOCUMENTS

| | | | |
|---|---|---|---|
| 1,113,371 | 10/1914 | Pajeau | 46/29 |
| 1,536,510 | 5/1925 | McGrath et al. | 273/128 R X |
| 2,884,254 | 4/1959 | Miner | 273/183 C |
| 3,458,949 | 8/1969 | Young | 46/29 X |
| 3,796,435 | 3/1974 | Dale | 273/199 R X |
| 3,918,720 | 11/1975 | Gordos | 273/58 K X |
| 3,972,532 | 8/1976 | Bradley | 273/183 C |
| 4,153,248 | 5/1979 | Holmes et al. | 273/58 K X |

*Primary Examiner*—George J. Marlo

[57] ABSTRACT

A golf putting device comprises a set of spaced golf balls or wheels with a sighting device, in the form of an actual or simulated golf ball, disposed therebetween. If both outer balls or wheels are struck simultaneously by a putter, the device will be propelled forward along a straight path; if one ball or wheel is struck ahead of the other, the device will be propelled along a curved path.

4 Claims, 4 Drawing Figures

FIG. 1
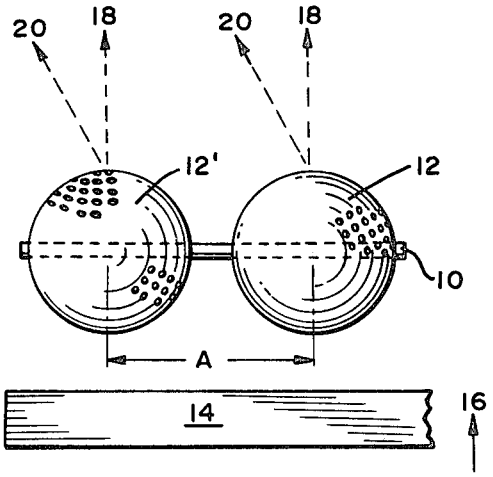
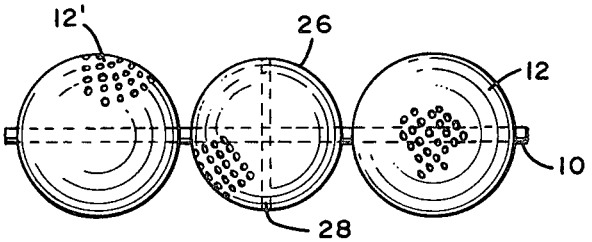
FIG. 2
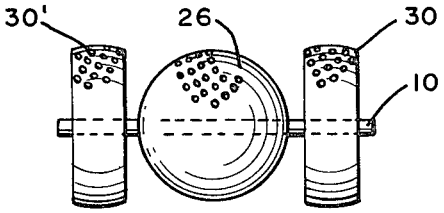
FIG. 3

GOLF PUTTING DEVICE

REFERENCE TO PRIOR APPLICATION

This application is a continuation-in-part application of Ser. No. 089,613 filed Oct. 29, 1979 now abandoned.

SUMMARY OF THE INVENTION

This invention relates to golf training devices and more particularly concerns a device for improving the putting by a golf player. Quite specifically, this invention refers to a golf putting device which reveals quickly whether the golf ball would have been addressed properly so as to be propelled in a straight path toward the cup. The putting device described hereinafter is particularly suited for indoor exercise or putting on a mat disposed on plane ground or flooring. The main advantage of the present device resides in its ability to clearly and convincingly reveal whether a golf ball upon being struck would have rolled in the desired direction, that is toward the cup, or would have wandered along a nondesired direction. Thus, it will be possible by the use of the device described herein to correct any faulty stance or incorrect putting stroke.

As is well known to golfers, putting is a most important aspect of a game and in many instances is decisive whether a game is won or lost. Great effort is made even by professional players to improve the skill of putting. Most putting training is done by repetitively putting, that is, striking a golf ball on even ground and propelling it a short distance toward a marker or a cup. While this exercise is helpful in achieving the proper skill, the device disclosed hereinafter provides a fast and most discernible view of the putting effort. Quite specifically, the deviation of the ball from its desired path due to a failure to address and strike the golf ball squarely is clearly evident. Thus, corrective action and the result thereof, once again, become apparent most quickly and most convincingly.

One of the principal objects of this invention is therefore the provision of a new and improved putting device for golf players.

Another principal object of this invention is the provision of a novel putting device which when struck by a golf putter clearly reveals whether the putting device was addressed squarely.

Still another important object of this invention is to provide a putting device which improves the putting ability of a golf player and provides immediate feedback of any wrong action.

A further significant object of this invention is the provision of a putting device which is readily manufactured, easy to use and which when struck is effective in revealing the path a golf ball would have taken.

Other and still further objects of this invention will be more clearly apparent from the following description when taken in conjunction with the accompanying drawings.

BRIEF DESCRIPTION OF THE DRAWINGS

FIG. 1 is a top plan view of a typical embodiment of my invention;

FIG. 2 is a top plan view of another embodiment;

FIG. 3 is a top plan view of still another embodiment, and

DESCRIPTION OF THE INVENTION

Figure 4:
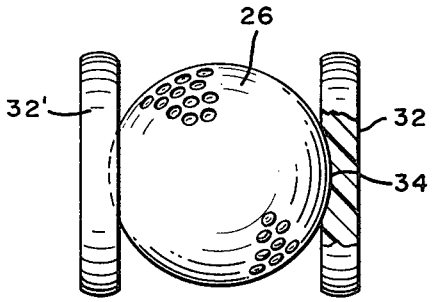
FIG. 4 is a top plan view, partially sectioned, of a further alternative embodiment.

Referring to the figures and FIG. 1 in particular, numeral 10 identifies a shaft upon which is mounted a pair of golf balls 12, 12'. The shaft 10 projects through the center of each ball and typically may comprise a heavy nail. Preferably the balls resiliently grip the shaft so that the entire structure rotates as a unitary device. The balls are spaced along the shaft, distance A, so that both balls can be addressed and struck simultaneously by the blade 14 of a golf putter. When the balls are struck by the putter, arrow 16, and the crown of both balls is impacted simultaneously, each ball will roll forward along direction 18—18. Assuming, however, that the blade 14 is slightly angled and ball 12 is struck ahead of ball 12', the putting device will roll forward in the direction 20—20 and will execute an amplified curved path. This curved path is immediately recognized by the golfer and he can take corrective action, that is, correcting his stance or stroke. The distance A determines the curvature of the path along which the device rolls upon one ball being struck ahead of the other.

FIG. 2 depicts a substantially identical device except a ball 26 of slightly smaller diameter has been placed on the shaft 10 between the balls 12 and 12'. The ball 26 serves as an aiming or sighting device which is addressed. It is important that the crown 28 of ball 26 is of smaller diameter than that of balls 12 and 12' in order that only balls 12 and 12' are in rolling contact with the ground or floor along which the putting device rolls and, moreover, to provide that ball 26 is not struck by the blade 14. In order to lighten the assembly the ball 26 may comprise a Ping Pong ball which is a hollow ball with thin shell.

FIG. 3 shows another variation of the present invention. Wheels 30, 30' are used instead of the complete golf balls 12 and 12' in FIGS. 1 and 2. The wheels may be made by suitably removing the not needed material from the golf balls 12 and 12'. Alternatively, the wheels are molded from material and equipped with a surface contour and texture which substantially equal that of the regulation golf balls. The embodiment per FIG. 3 reduces the extra weight present in the device per FIG. 2 and, hence, more closely approaches the weight of a single ball. The smaller ball 26, once again, serves as a sighting device, but it will be understood that the sighting device may be of other shape to suit the desire of the player. If desired, the wheels 30, 30' as well as the balls 12, 12' may be painted in subdued color while the sighting device is painted with a contrasting color, typically white as applies to a golf ball.

In another embodiment, not shown, the entire device may be molded as a unitary structure in order to save weight and cost.

In a further alternative embodiment shown by FIG. 4, a regular golf ball 26 is secured between a pair of wheels 32 and 32'. The side face of each wheel may include a cavity 34 in order to accurately locate therein the golf ball. The assembly of golf ball and wheels is bonded to each other by adhesive bonding means or sealing means. The diameter of the wheels 32, 32' (crown) is slightly greater than the diameter of the golf ball 26 in order to lift the ball from the underlying surface. The wheels may be made from clear plastics, machined or moulded to the final shape.

It will be apparent to those skilled in the art that the present device presents a most convenient training device devised for improving the stance and stroke of a golfer and that the results of a faulty putting stroke are immediately apparent in an amplified manner.

While there have been described and illustrated several preferred embodiments of my invention, it will be apparent to those skilled in the art that still further modifications may be made without deviating from the broad principle of the invention which shall be limited only by the scope of the appended claims.

What is claimed is:

1. A golf putting device comprising:

a pair of spaced concentrically rotating wheels having a crown diameter approximating that of a golf ball and being spaced from each other by a distance for being addressed by a putter;

a sighting device in the form of an actual or simulated golf ball concentrically mounted between and to said wheels, and the diameter of said wheels being slightly greater than that of said ball for causing said ball to be free of rolling contact with an underlying surface upon which said wheels roll.

2. A golf putting device as set forth in claim 1, and a shaft upon which said wheels and ball are mounted concentrically.

3. A golf putting device as set forth in claim 1, each of said wheels having a respective recess in its side which faces the other wheel and said actual or simulated ball being secured within the respective recess of each wheel.

4. A golf putting device comprising:

a pair of spaced wheels having a crown diameter approximating that or slightly larger than that of a regulation golf ball, said wheels being spaced from one another by a distance for being addressed by a putter;

a golf ball or golf ball simulating sighting device disposed in the space between said wheels, said ball or sighting device being of a diameter smaller than that of said wheels for causing said wheels to be in rolling contact with a surface along which said putting device is to be propelled and said ball or sighting device to be free of such contact, and means for causing said wheels and ball or sighting device to be secured to one another for rotating in a unitary manner.

* * * * *